US005399452A

United States Patent [19]

Takegawa et al.

[11] Patent Number: 5,399,452

[45] Date of Patent: Mar. 21, 1995

[54] ELECTROPHOTOGRAPHIC PHOTORECEPTOR

[75] Inventors: Ichiro Takegawa; Kazuyuki Nakamura; Kiyokazu Mashimo; Tomoo Kobayashi; Toru Ishii; Yutaka Akasaki, all of Minami-ashigara, Japan

[73] Assignee: Fuji Xerox Co., Ltd., Tokyo, Japan

[21] Appl. No.: 8,974

[22] Filed: Jan. 26, 1993

[30] Foreign Application Priority Data

Jan. 27, 1992 [JP] Japan ..... 4-033981
Feb. 7, 1992 [JP] Japan ..... 4-055995

[51] Int. Cl.[6] ..... G03G 5/047

[52] U.S. Cl. ..... 430/58; 430/56; 430/66; 430/67; 430/96

[58] Field of Search ..... 430/66, 96, 67, 56, 430/58

[56] References Cited

U.S. PATENT DOCUMENTS

| | | | |
|---|---|---|---|
| 4,346,158 | 8/1982 | Pai et al. | 430/96 |
| 4,766,048 | 8/1988 | Hisamura et al. | 430/66 |
| 4,931,372 | 6/1990 | Takei et al. | 430/66 |
| 4,948,690 | 8/1990 | Hisamura et al. | 430/58 |

FOREIGN PATENT DOCUMENTS

| | | |
|---|---|---|
| 63-2072 | 1/1988 | Japan . |
| 63-244039 | 10/1988 | Japan . |
| 1-205171 | 8/1989 | Japan . |
| 2-2072 | 1/1990 | Japan . |
| 2-143257 | 6/1990 | Japan . |
| 2-240659 | 9/1990 | Japan . |
| 4-19750 | 1/1992 | Japan . |

OTHER PUBLICATIONS

*Organic Coating Technology;* H. Payne; John Wiley & Sons, Inc., N.Y.; 1954; pp. 337–338.

*Primary Examiner*—Christopher D. Rodee
*Attorney, Agent, or Firm*—Oliff & Berridge

[57] ABSTRACT

An electrophotographic photoreceptor comprising an electroconductive support having thereon a light-sensitive layer. At least the outermost layer of the light-sensitive layer contains (1) fine grains of at least one of a melamine-formaldehyde condensate and a benzoguanamine-formaldehyde condensate, and, as a binder resin, a polycarbonate resin comprising a constitutive unit represented by formula (II); or (2) fine grains of a benzoguanamine-melamine-formaldehyde condensate having an average grain size of from 0.03 to 4 μm.

7 Claims, 1 Drawing Sheet

ELECTROPHOTOGRAPHIC PHOTORECEPTOR

FIELD OF THE INVENTION

The present invention relates to an electrophotographic photoreceptor having an improved surface layer and, more specifically, to that having excellent abrasion resistance and environment stability and high durability.

BACKGROUND OF THE INVENTION

Since an electrophotographic device involves an advantage in that the printing speed thereof is high to give a high printing quality, it has widely been applied to various fields of duplicators and laser beam printers.

As an electrophotographic photoreceptor used in such an electrophotographic device, inorganic photoconductive materials such as selenium, selenium-tellurium alloys, selenium-arsenic alloys, cadmium sulfide and zinc oxide have widely been known. Organic photoconductive materials have come to be used to form an organic photoreceptor. For instance, development of charge generating materials such as polyvinyl carbazole compounds as well as bisazo compounds, perylene pigments and phthalocyanine pigments and low molecular weight charge transporting materials such as pyrazoline compounds and hydrazone compounds has been promoted and use of them is being popularized gradually. Regarding the constitution of the photoreceptor using organic photoconductive materials, a function-separated laminate structure composed of a charge generating layer containing Se/polyvinyl carbazole or the like and a charge transporting layer as separated from each other has been developed and has come to be utilized more popularly than the simple structure comprising a polyvinyl carbazoletrinitrofluorenone charge transfer complex or the single layer structure containing a charge generating material as dispersed in a binder resin, which have been developed previously. Thus, the capacity of the photoreceptor has been improved.

In general, a photoreceptor is continuously exposed to mechanical abrasion in an electrophotographic apparatus due to contact with the developing device, developing agent and cleaning device. Since the organic photoreceptor is mainly composed of organic materials, it involves a drawback that the mechanical strength is low. Thus, the thickness of the light-sensitive layer decreases or a toner would adhere onto the scratches as formed on the surface of the light-sensitive layer during the electrophotographic operation and, as a result, the scratches on the light-sensitive layer are printed as image defects or fog generates on white non-image areas in the printed images.

In order to overcome the drawback, an attempt has been made to improve the surface of the light-sensitive layer of a photoreceptor and to reduce the abrasion or scratches of the light-sensitive layer thereof so as to prolong the life of the photoreceptor itself.

For instance, various reports have heretofore been made of adding an abrasion-resistant fine granular material (hereinafter sometimes referred as "fine grains") to the surface layer of a light-sensitive layer of a photoreceptor so as to reduce abrasion of the light-sensitive layer and to reduce scratches on the surface of the layer. JP-A-2-2072 (the term "JP-A" as used herein means an "unexamined published Japanese patent application") discloses a method of adding spherical powder of a hardening type resin to the surface layer of a photoreceptor, in which use of spherical silicone resins and the like is exemplified. JP-A-63-244039 discloses addition of a solid lubricant such as a metal soap; JP-A-1-205171 discloses addition of an inorganic filler; and JP-A-2-143257 discloses addition of surface-treated polyethylene powder.

However, if fine grains are added to the light-sensitive layer of a photoreceptor, the light as applied thereto is generally scattered by the added fine grains to lower the sensitivity of the photoreceptor or to retard the migration of the generated carrier, whereby the light attenuating characteristic of the photoreceptor is deteriorated to yield a high residual potential. As a result, addition of such fine grains causes various troubles of generation of fog, black peppers and dot-like non-image areas in the image formed.

Further, addition of such fine grains also causes still other various problems, depending upon the kind of materials for them. For example, fine grains of an inorganic material have a rapid precipitating rate in a coating composition so that the coating composition containing them involves a problem of stability. Conventional organic fine grains are insufficient with respect to the heat resistance and solvent resistance. Where electroconductive fine grains are added to a charge transporting layer, they noticeably lower the charged electric potential of the photoreceptor.

JP-A-63-2072 and JP-A-2-240659 disclose addition of a fine grains of a spherical melamine resin and fine grains of a benzoguanamine-formaldehyde condensate, respectively, to the light-sensitive layer of a photoreceptor.

In the case of adding fine grains of a melamine resin, the grains display an excellent effect for improving the abrasion resistance of the light-sensitive layer since the fine grains of a melamine resin are extremely hard and tough. However, since the grains have a high water-absorbing capacity so that when they are added to a photoreceptor, it causes potential trapping in the photoreceptor. As a result, the residual potential of the photoreceptor is noticeably elevated due to the addition of the powder so that the potential fluctuation under environmental variation becomes great. Thus, addition of the grains involves such various problems.

In the case of adding fine grains of a benzoguanamine-formaldehyde condensate to the light-sensitive layer of a photoreceptor, since the grains are coarse to have a large grain size of an order of 10 μm. If such coarse grains are added to such a charge transporting layer having the largest thickness of from 10 to 40 μm, the surface roughness of the surface layer of the photoreceptor would be great so that the uniformity of the latent image to be formed would be lost. As a result, poor images having much fog could only be obtained, defectively, by the use of the photoreceptor containing the grains.

As mentioned above, the prior art of improving the abrasion resistance of a photoreceptor still involves various problems.

The present invention has been made so as to overcome the problems in the prior art, in consideration of the current situation mentioned above.

SUMMARY OF THE INVENTION

An object of the present invention is to provide an electrophotographic photoreceptor of satisfying both the improved wearing resistance and releasability and the intrinsic electric characteristics thereof capable of giving high quality images.

Another object of the present invention is to provide an electrophotographic photoreceptor having a high mechanical strength and excellent abrasion resistance and environment stability with still having the intrinsic electric characteristics thereof capable of forming defect free images of high quality.

Other objects and effects of the present invention will be apparent from the following description.

The present inventors earnestly studied and, as a result, have found that combination of fine grains of a melamine-formaldehyde condensate or benzoguanamine-formaldehyde condensate and particular polycarbonate resin provides an excellent dispersibility and a photoreceptor having both improved wearing resistance and releasability of the surface layer and the intrinsic electric characteristics of the photoreceptor itself of giving high quality images.

The present inventors also found that a photoreceptor having a high mechanical strength and excellent abrasion resistance and environment stability with still having the intrinsic electric characteristics by incorporating fine grains of a benzoguanamine-melamine-formaldehyde condensate having a grain size of falling within a defined range into the surface layer of a photoreceptor.

On the basis of the finding, the present invention has been completed.

The present invention relates to, as a first aspect, an electrophotographic photoreceptor comprising an electroconductive support having thereon a light-sensitive layer, at least the outermost layer of said light-sensitive layer containing fine grains of at least one of a melamine-formaldehyde condensate and a benzoguanamine-formaldehyde condensate, and, as a binder resin, a polycarbonate resin comprising a constitutive unit represented by formula (II):

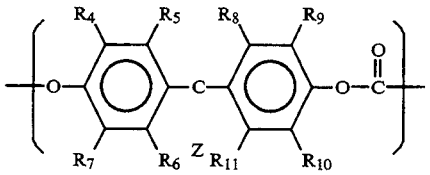

(II)

wherein $R_4$ to $R_{11}$, which may be the same or different, each represent a hydrogen atom, a halogen atom, a substituted or unsubstituted alkyl group, or a substituted or unsubstituted cycloalkyl group; and Z represents an atomic group for forming a substituted or unsubstituted carbon ring containing the carbon atom between the phenylene groups.

The present invention also relates to, as a second aspect, an electrophotographic photoreceptor comprising an electroconductive support having thereon a light-sensitive layer, at least the outermost layer of said light-sensitive layer containing fine grains of a benzoguanamine-melamine-formaldehyde condensate having an average grain size of from 0.03 to 4 μm.

DETAILED DESCRIPTION OF THE INVENTION

The light-sensitive layer to be formed on the electroconductive support may have either a single layer structure or a function-separated laminate structure comprising a charge generating layer and a charge transporting layer. In the case of the latter laminate structure, the order of the charge generating layer and the charge transporting layer is not limitative and either of them may be above the other. If desired, a surface-protecting layer may be provided. The present invention may apply to any photoreceptor having any layer constitution.

The outermost layer of the light-sensitive layer may be either the light-sensitive layer itself, the charge transporting layer, the charge generating layer, the surface-protecting layer or any other layers constituting the light sensitive layer, as long as the outermost layer contains fine grains of at least one of a melamine-formaldehyde condensate and a benzoguanamine-formaldehyde condensate, and, as a binder resin, a polycarbonate resin comprising a constitutive unit represented by formula (II), or contains fine grains of a benzoguanamine-melamine-formaldehyde condensate having an average grain size of from 0.03 to 4 μm.

It will be explained hereunder with reference to a laminate structure photoreceptor, as one non-limitative embodiment.

Figure 1:
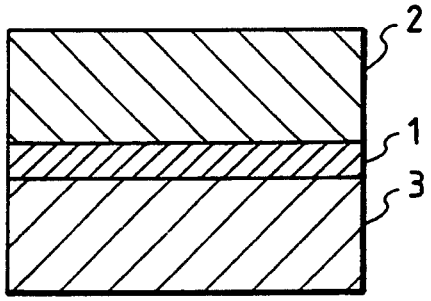
FIG. 1 is a schematic sectional view showing one embodiment of the electrophotographic photoreceptor of the present invention.
Figure 2:
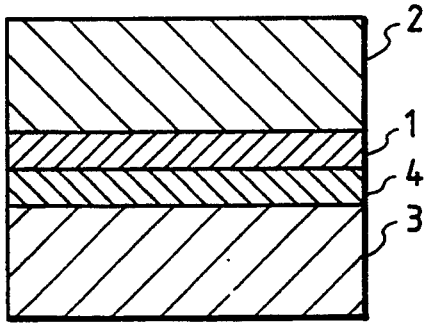
FIG. 2 is a schematic sectional view showing another embodiment of the electrophotographic photoreceptor of the present invention.

FIG. 1 and FIG. 2 each are a schematic sectional view of showing embodiments of the electrophotographic photoreceptor having the function-separated laminate structure according to the present invention. In FIG. 1, charge generating layer 1 is provided on electroconductive support 3, and charge transporting layer 2 is provided on charge generating layer 1. In FIG. 2, subbing layer 4 is further provided between support 3 and charge generating layer 1.

Examples of materials constituting the electroconductive support for use in the present invention include metals such as aluminum, copper, iron, zinc, nickel, chromium and stainless steel; plastic films each coated with a thin film of, for example, aluminum, copper, silver, platinum, palladium, titanium, nickel, chromium, nickel-chromium, stainless steel, gold, vanadium, tin oxide, indium oxide or ITO; and paper, plastic films and glass each coated with an electroconductivity-imparting material or containing the material as impregnated thereinto.

The electroconductive support may be in any form of a drum, sheet or plate, without limitation. If desired, the surface of the electroconductive support may be treated variously as long as the treatment creates no adverse influence on the quality of the images to be formed. For instance, the surface may be treated by oxidation or by chemicals or colorants, or may also be sand-grained for diffused reflection.

If desired, a subbing layer may be provided between the electroconductive support and the charge generating layer. The subbing layer has a function of inhibiting migration of charges from the electroconductive support to the light-sensitive layer having the laminate structure during electrically charging the light-sensitive layer, and has a function as a adhesive layer of temporarily adhering the light-sensitive layer to the support.

It may also have a function of inhibiting the reflected light from the support.

Known materials may be used for constituting the subbing layer. Examples thereof include polyethylene resins, polypropylene resins, acrylic resins, methacrylic resins, polyamide resins, vinyl chloride resins, vinyl acetate resins, phenolic resins, polycarbonate resins, polyurethane resins, polyimide resins, vinylidene chloride resins, polyvinyl acetal resins, vinyl chloride-vinyl acetate copolymer resins, polyvinyl alcohol resins, water-soluble polyester resins, nitrocellulose, casein, gelatin, polyglutamic acid, starch, starch acetate, amino starch, polyacrylic acid, polyacrylamide, zirconium chelate compounds, titanyl chelate compounds, titanyl alkoxide compounds, organic titanyl compounds, and silane coupling agents.

For forming the subbing layer, a coating composition containing the above material may be coated over the support. Any conventional method may be employed for coating, including, for example, a blade coating method, a wire bar coating method, a spray coating method, a dip coating method, a bead coating method, an air knife coating method, and a curtain coating method. The thickness of the subbing layer is generally within the range of from 0.01 to 10 μm, preferably from 0.05 to 2 μm.

The charge generating layer is generally formed by vacuum vapor deposition of a charge generating material on the support or by coating the support with a dispersion (coating composition) containing a charge generating material along with an organic solvent and a binder resin.

Examples of the charge generating material include inorganic photoconductive materials such as amorphous selenium, crystalline selenium, selenium-tellurium alloys, selenium-arsenic alloys and other selenium compounds and selenium alloys, zinc oxide and titanium oxide; and various organic pigments and dyes such as various phthalocyanine pigments, e.g., metal free phthalocyanine, titanyl phthalocyanine, copper phthalocyanine, tin phthalocyanine and gallium phthalocyanine, as well as squalium compounds, anthanthorone compounds, perylene compounds, azo compounds, anthraquinone compounds, pyrene compounds, pyrylium salts and thiapyrylium salts. Such organic pigments generally have crystal forms of several kinds. In particular, while α and β crystal forms are well known as phthalocyanine pigments, either of them may be used in the present invention.

Examples of the binder resin used in the charge generating layer include bisphenol A type or bisphenol Z type polycarbonate resins, polyester resins, methacrylic resins, acrylic resins, polyvinyl chloride resins, polystyrene resins, polyvinyl acetate resins, styrene-butadiene copolymer resins, vinylidene chloride-acrylonitrile copolymer resins, vinyl chloride-vinyl acetate-maleic anhydride resins, silicone resins, silicone-alkyd resins, phenol-formaldehyde resins, styrene-alkyd resins, poly-N-vinylcarbazoles. The binder resins may be used singly or in combination of two or more of them.

The proportion of the charge generating material to the binder resin is generally within the range of from 10/1 to 1/10 by weight. The thickness of the charge generating layer is generally within the range of from 0.01 to 5 μm, preferably from 0.05 to 2.0 μm.

The charge generating layer may be formed by coating a coating composition containing the charge generating material and binder resin on the support. Conventional organic solvents may be used in forming the coating composition, including, for example, methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride and chloroform. The solvents may be used singly or in combination of two or more of them.

For coating the composition, any conventional method may be employed, including, for example, a blade coating method, wire bar coating method, a spray coating method, a dip coating method, a bead coating method, an air knife coating method, and a curtain coating method.

The charge transporting layer generally comprises a charge transporting material and a binder resin.

Examples of the charge transporting material for use in the present invention include positive hole transporting substances, for example, oxadiazole derivatives such as 2,5-bis(p-diethylaminophenyl)-1,3,5-oxadiazole, pyrazoline derivatives such as 1,3,5-triphenyl-pyrazoline and 1-[pyridyl-(2)]-3-(p-diethylaminostyryl)-5-(p-diethylaminostyryl)pyrazoline, aromatic tertiary amino compounds such as triphenylamine and dibenzylamine, aromatic tertiary diamino compounds such as N,N'-diphenyl-N,N'-bis(3-methylphenyl)-[1,1-biphenyl]-4,4'-diamine, 1,2,4-triazine derivatives such as 3-(4'-dimethylaminophenyl)-5,6-di-(4'-methoxyphenyl)-1,2,4-triazine, hydrazone derivatives such as 4-diethylaminobenzaldehydo-1,1-diphenylhydrazone, quinazoline derivatives such as 2-phenyl-4-styrylquinazoline, benzofurane derivatives such as 6-hydroxy-2,3-di-(p-methoxyphenyl)-benzofurane, α-stilbene derivatives such as p-(2,2-diphenylvinyl)-N,N-diphenylaniline, enamine derivatives, carbazole derivatives such as N-ethylcarbazole, and poly-N-vinylcarbazole and its derivatives; electron transporting substances, for example, quinone compounds such as chloranil, bromoanil and anthraquinone, tetracyanoquinodimethane compounds, fluorenone compounds such as 2,4,7-trinitrofluorenone and 2,4,5,7-tetranitro-9-fluorenone, xanthone compounds and thiophene compounds; and polymers having groups derived from the preceding compounds as the main chain or side chains. The charge transporting substances may be used singly or in combination of two or more of them.

In the first aspect of the present invention, if the charge transporting layer contains the fine grains of a melamine-formaldehyde condensate and/or a benzoguanamine-formaldehyde condensate and the polycarbonate resin of formula (II), the charge transporting material is preferably a benzidine compound represented by formula (I):

(I)

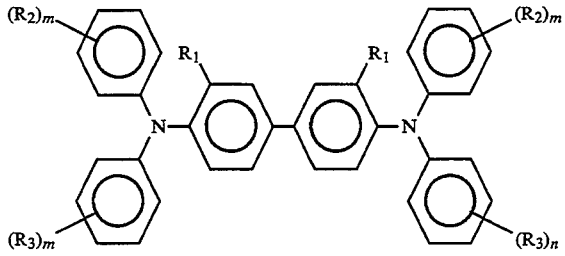

wherein $R_1$ represents a hydrogen atom, an alkyl group, an alkoxy group, or a halogen atom; $R_2$ and $R_3$, which may be same as or different, each represents a hydrogen atom, an alkyl group, an alkoxy group, a halogen atom, or a substituted amino group; and m and n each represent an integer of from 0 to 2.

In the second aspect of the present invention, a benzidine compound represented by formula (I) is preferably used as the charge transporting material.

Among the benzidine compounds of formula (I), preferred are those represented by formulae (III) and (IV):

(III)

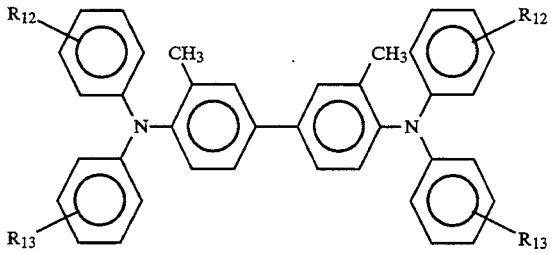

wherein $R_{12}$ and $R_{13}$, which may be the same or different, each represents a hydrogen atom or a methyl group, (IV)

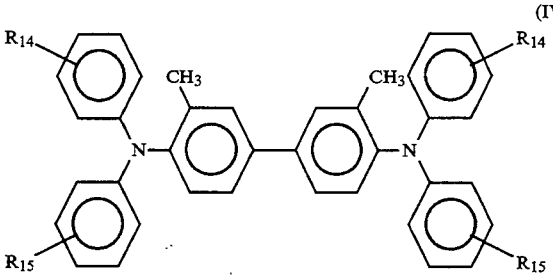

wherein one of $R_{14}$ and $R_{15}$ represents an alkyl group having 2 or more carbon atoms, and the other represents a hydrogen atom, an alkyl group, an alkoxy group or a substituted amino group.

The benzidine compounds represented by formulae (III) and (IV) have high solubility in solvents and have high compatibility with resins and therefore give a uniform film and a uniform interface. Therefore, they are especially preferred, as capable of forming an electrophotographic photoreceptor having a high sensitivity and high stability to repeated use.

The use of benzidine compounds represented by formula (IV) is particularly preferred in the present invention.

Specific examples of benzidine compounds of formula (I) for use in the present invention are mentioned in Tables 1 and 2 below, in which $R_1$ to $R_3$ correspond to those in formula (I), respectively. They may be used either singly or in combination of two or more of them.

TABLE 1

| Compound No. | $R_1$ | $R_2$ | $R_3$ |
|---|---|---|---|
| I-1 | $CH_3$ | H | H |
| I-2 | $CH_3$ | 2-$CH_3$ | H |
| I-3 | $CH_3$ | 3-$CH_3$ | H |
| I-4 | $CH_3$ | 4-$CH_3$ | H |
| I-5 | $CH_3$ | 4-$CH_3$ | 2'-$CH_3$ |
| I-6 | $CH_3$ | 4-$CH_3$ | 3'-$CH_3$ |
| I-7 | $CH_3$ | 4-$CH_3$ | 4'-$CH_3$ |

TABLE 1-continued

| Compound No. | $R_1$ | $R_2$ | $R_3$ |
|---|---|---|---|
| I-8 | $CH_3$ | 3,4-$CH_3$ | H |
| I-9 | $CH_3$ | 3,4-$CH_3$ | 3',4'-$CH_3$ |
| I-10 | $CH_3$ | 4-$C_2H_5$ | H |
| I-11 | $CH_3$ | 4-$C_3H_7$ | H |
| I-12 | $CH_3$ | 4-$C_4H_9$ | H |
| I-13 | $CH_3$ | 4-$C_2H_5$ | 2'-$CH_3$ |
| I-14 | $CH_3$ | 4-$C_2H_5$ | 3'-$CH_3$ |
| I-15 | $CH_3$ | 4-$C_2H_5$ | 4'-$CH_3$ |
| I-16 | $CH_3$ | 4-$C_2H_5$ | 3',4'-$CH_3$ |
| I-17 | $CH_3$ | 4-$C_3H_7$ | 3'-$CH_3$ |
| I-18 | $CH_3$ | 4-$C_3H_7$ | 4'-$CH_3$ |
| I-19 | $CH_3$ | 4-$C_4H_9$ | 3'-$CH_3$ |
| I-20 | $CH_3$ | 4-$C_4H_9$ | 4'-$CH_3$ |
| I-21 | $CH_3$ | 4-$C_2H_5$ | 4'-$C_2H_5$ |
| I-22 | $CH_3$ | 4-$C_2H_5$ | 4'-$OCH_3$ |
| I-23 | $CH_3$ | 4-$C_3H_7$ | 4'-$C_3H_7$ |
| I-24 | $CH_3$ | 4-$C_3H_7$ | 4'-$OCH_3$ |
| I-25 | $CH_3$ | 4-$C_3H_7$ | 4'-$C_4H_9$ |
| I-26 | $CH_3$ | 4-$C_4H_9$ | 4'-$OCH_3$ |

TABLE 2

| Compound No. | $R_1$ | $R_2$ | $R_3$ |
|---|---|---|---|
| I-27 | H | 3-$CH_3$ | H |
| I-28 | Cl | H | H |
| I-29 | Cl | 2-$CH_3$ | H |
| I-30 | Cl | 3-$CH_3$ | H |
| I-31 | Cl | 4-$CH_3$ | H |
| I-32 | Cl | 4-$CH_3$ | 2'-$CH_3$ |
| I-33 | Cl | 4-$CH_3$ | 3'-$CH_3$ |
| I-34 | Cl | 4-$CH_3$ | 4'-$CH_3$ |
| I-35 | $C_2H_5$ | H | H |
| I-36 | $C_2H_5$ | 2-$CH_3$ | H |
| I-37 | $C_2H_5$ | 3-$CH_3$ | H |
| I-38 | $C_2H_5$ | 4-$CH_3$ | H |
| I-39 | $C_2H_5$ | 4-$CH_3$ | 4'-$CH_3$ |
| I-40 | $C_2H_5$ | 4-$C_2H_5$ | 4'-$CH_3$ |
| I-41 | $C_2H_5$ | 4-$C_3H_7$ | 4'-$CH_3$ |
| I-42 | $C_2H_5$ | 4-$C_4H_9$ | 4'-$CH_3$ |
| I-43 | $OCH_3$ | H | H |
| I-44 | $OCH_3$ | 2-$CH_3$ | H |
| I-45 | $OCH_3$ | 3-$CH_3$ | H |
| I-46 | $OCH_3$ | 4-$CH_3$ | H |
| I-47 | $OCH_3$ | 4-$CH_3$ | 4'-$CH_3$ |
| I-48 | $OCH_3$ | 4-$C_2H_5$ | 4'-$CH_3$ |
| I-49 | $OCH_3$ | 4-$C_3H_7$ | 4'-$CH_3$ |
| I-50 | $OCH_3$ | 4-$C_4H_9$ | 4'-$CH_3$ |
| I-51 | $CH_3$ | 2-$N(CH_3)_2$ | H |
| I-52 | $CH_3$ | 3-$N(CH_3)_2$ | H |
| I-53 | $CH_3$ | 4-$N(CH_3)_2$ | H |

Examples of the binder resin used in the charge transporting layer include insulating resins, for example, acrylic resins, polyacrylates, polyester resins, polycarbonate resins such as bisphenol A type or bisphenol B type resins, polystyrene, acrylonitrile-styrene copolymers, acrylonitrile-butadiene copolymers, polyvinyl butyral, polyvinyl formal, polysulfone, polyacrylamide, polyamide and chlorinated rubber; and organic photoconductive polymers such as polyvinyl carbazole, polyvinyl anthracene and polyvinyl pyrene.

In the first aspect of the present invention, a polycarbonate resin comprising a repeating unit represented by formula (II) is used as the binder resin in the layer containing the fine grains of a melamine-formaldehyde condensate and/or a benzoguanamine-formaldehyde condensate.

In the second aspect of the present invention, a polycarbonate resin comprising a repeating unit represented by formula (II) is preferably used as the binder resin in the layer containing the fine grains of a benzoguanamine-melamine-formaldehyde condensate.

Specific examples of the polycarbonate resin comprising the repeating unit represented by formula (II) for use in the present invention are mentioned in Table 3 below, in which Z and $R_4$ to $R_{11}$ correspond to those in formula (II), respectively. They may be used either singly or in combination of two or more of them. Among these, Compounds (II-1) to (II-3) are particularly preferred.

TABLE 3

| No. | Z | $R_4$ | $R_5$ | $R_6$ | $R_7$ | $R_8$ | $R_9$ | $R_{10}$ | $R_{11}$ |
|---|---|---|---|---|---|---|---|---|---|
| II-1 | 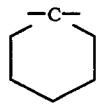 | H | H | H | H | H | H | H | H |
| II-2 | | $CH_3$ | H | H | H | H | H | $CH_3$ | H |
| II-3 | | Cl | H | H | H | H | H | Cl | H |
| II-4 | 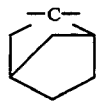 | H | H | H | H | H | H | H | H |
| II-5 | | $CH_3$ | H | H | H | H | H | $CH_3$ | H |
| II-6 | 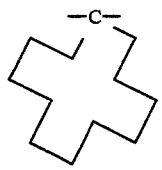 | H | H | H | H | H | H | H | H |
| II-7 | | $CH_3$ | H | H | H | H | H | $CH_3$ | H |
| II-8 | 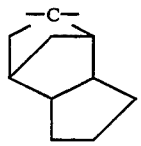 | H | H | H | H | H | H | H | H |
| II-9 | | $CH_3$ | H | H | H | H | H | $CH_3$ | H |
| II-10 | 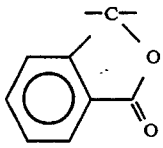 | H | H | H | H | H | H | H | H |
| II-11 | | $CH_3$ | H | H | H | H | H | $CH_3$ | H |

The charge transporting layer may be formed by coating a coating composition containing the charge transporting material and the binder resin as dissolved in a suitable solvent followed by drying. Examples of the solvent to be used for forming the coating composition for the charge transporting layer include aromatic hydrocarbons such as benzene, toluene and chlorobenzene; ketones such as acetone and 2-butanone; halogenated aliphatic hydrocarbons such as methylene chloride, chloroform and ethylene chloride; cyclic or linear ethers such as tetrahydrofuran, dioxane, ethylene glycol and diethyl ether; and a mixed solvent comprising them. The proportion of the charge transporting material to the binder resin is generally from 10/1 to 1/5 by weight. The thickness of the charge transporting layer is generally within the range of from 5 to 50 μm, preferably from 10 to 40 μm.

The proportion of the charge transporting material to the binder resin is preferably from 10/1 to 1/5 by weight. The higher the amount of fine grains of a melamine-formaldehyde condensate and a benzoguanamine-formaldehyde condensate is, the better the wearing resistance of the light-sensitive layer of the photoreceptor of the invention. However, if it is too high, the fine grains would cause elevation of the secondary hindrance to the electric characteristics of the photoreceptor and the image quality of images to be formed. Therefore, the amount of the fine grains is generally from 0.01 to 20% by weight, preferably from 0.1 to 10% by weight, based on the solid content of the charge transporting layer.

A coating composition for forming the charge transporting layer may be prepared in the manner mentioned below. First, a mixture containing the charge transporting material and the polycarbonate resin is prepared, then the fine grains are added thereto if they are used in the charge transporting layer, and the resulting mixture is dispersed with a known dispersing device such as a roll mill, a sand mill, a ball mill, an attritor or a paint shaker.

For coating the resulting coating composition, any known method may be employed, including, for example, a blade coating method, a Meyer bar coating method, a spray coating method, a dip coating method, a bead coating method, an air knife coating method, and a curtain coating method.

In the case where the light-sensitive layer has the single layer structure, the thickness of the light-sensitive layer is generally from 2 to 100 μm, preferably from 5 to 50 μm.

As fine grains of a melamine-formaldehyde condensate and a benzoguanamine-formaldehyde condensate added to at least the outermost layer in the first aspect of the present invention, those having an average grain size of from 0.03 to 4 μm are preferred, and from 0.1 to 2 μm are more preferred. The fine grains of the first aspect of the present invention are generally spherical white particles and are insoluble in all organic solvents. The fine grains generally has a refractive index of 1.5 to 1.6, a true specific gravity of 1.2 to 1.8, a bulk specific gravity of 0.2 to 0.8, a specific surface area of 0.1 to 25 $m^2/g$, an oil absorbance of 50 to 110 ml/100 g, and water absorption of some extent.

In accordance with the second aspect of the present invention, the fine grains of a benzoguanamine-melamine-formaldehyde condensate are incorporated into at least the outermost layer of the photoreceptor. In the case of a photoreceptor where a surface protecting layer is formed on the light-sensitive layer, the fine grains of a benzoguanamine-melamine-formaldehyde condensate are incorporated into the surface protecting layer.

The fine grains of a benzoguanamine-melamine-formaldehyde condensate for use in the present invention comprise a polycondensate of benzoguanamine, melamine and formaldehyde. The proportion of benzoguanamine to melamine is generally within the range of from 1/9 to 9/1 by weight, preferably from 3/7 to 7/3 by weight. The average grain size of the fine grains is within the range of from 0.03 μm to 4 μm, preferably from 0.2 to 4 μm. The fine grains have a three-dimensional structure so that determination of the polymerization degree of them is difficult. The fine grains of the second aspect of the present invention are generally spherical white particles and are insoluble in all organic solvents. The fine grains generally has a refractive index of 1.5 to 1.6, a true specific gravity of 1.2 to 1.6, a bulk specific gravity of 0.2 to 0.8, a specific surface area of 0.1 to 10 $m^2/g$, an oil absorbance of 50 to 110 ml/100 g, and water absorption of some extent.

The higher the amount of the fine grains used in the first and second aspects of the present invention is, the better the wearing resistance of the light-sensitive layer. However, if it is too high, the fine grains would cause elevation of the secondary hindrance to the electric characteristics of the photoreceptor and the image quality of images to be formed. Therefore, the amount of the fine grains is generally from 0.01 to 20% by weight, preferably from 0.1 to 10% by weight, based on the solid content of the layer to which the fine grains are added.

The fine grains are added to the coating composition, and the resulting coating composition is milled with a known dispersing device such as a roll mill, a sand mill, a ball mill, an attritor or a paint shaker and then coated.

The fine grains used in the present invention are insulating fine grains which have substantially uniformly and sufficiently been hardened, and the have true specific gravity of as light as about 1.4, which is not so different from that of the material of constituting the light-sensitive layer. In addition, the fine grains are stable as being insoluble in substantially all solvents and is not decomposed even at 300° C. Accordingly, precipitation of the fine grains in the coating composition is little and they do not dissolve in the solvent in the coating composition, which are thus different from those used in conventional coating compositions.

If desired, a surface-protecting layer may be provided as the outermost layer of the light-sensitive layer. The surface-protecting layer may be an insulating resin protective layer or a low-resistance protective layer comprising an insulating resin and a resistance adjusting agent as added thereto. Examples of the low-resistance protective layer include a layer containing electroconductive fine grains as dispersed in an insulating resin. Examples of the electroconductive fine grains to be in the layer include white, gray or bluish white fine grains having an electric resistance of $10^9$ Ω.cm or less and a mean grain size of 0.3 μm or less, preferably 0.1 μm or less, for example, fine grains of molybdenum oxide, tungsten oxide, antimony oxide, tin oxide, titanium oxide, indium oxide, and a solid solution or a mixture comprising tin oxide and antimony or antimony oxide; as well as mixed fine grains prepared by incorporating such metal oxides into fine grains of a simple substance, or coated fine grains to be prepared by coating fine grains of a simple substance with such metal oxides. Fine grains of tin oxide or a solid solution comprising tin oxide and antimony or antimony oxide are preferred, as they may suitably adjust the electric resistance of the protective layer and the protective layer containing them may be substantially transparent, as described in JP-A-57-30847 and JP-A-57-128344.

Examples of the insulating resins include condensed resins such as polyamides, polyurethanes, polyesters, epoxy resins, polyketones and polycarbonates, as well as vinyl polymers such as polyvinyl ketone, polystyrene and polyacrylamide.

In the case where the photoreceptor according to the first aspect of the present invention has a surface-protecting layer, the surface-protecting layer as the outermost layer contains the fine grains of a melamine-formaldehyde condensate and/or a benzoguanamine-formaldehyde condensate, and a polycarbonate resin comprising a constitutive unit represented by formula (II), preferably Compounds (II-1) to (II-3).

In the case where the photoreceptor according to the second aspect of the present invention has a surface-protecting layer, the surface-protecting layer as the outermost layer contains the fine grains of a benzoguanamine-melamine-formaldehyde condensate and the above-mentioned binder resins. The binder resin is preferably a polycarbonate resin comprising a constitutive unit represented by formula (II), more preferably Compounds (II-1) to (II-3).

The electrophotographic photoreceptor of the present invention may contain, in the light-sensitive layer thereof, various additives such as antioxidant, light stabilizer and heat stabilizer, for the purpose of preventing deterioration of the photoreceptor due to ozone or oxidizing gas to be generated in duplicators and also due to light or heat as applied thereto.

Examples of the antioxidants include hindered phenols, hindered amines, paraphenylenediamine, arylalkanes, hydroquinones, spirochromans spiroindanones and their derivatives, as well as other organic sulfur compounds and organic phosphorus compounds.

Examples of the light stabilizers include derivatives of benzophenones, benzotriazoles, dithiocarbamates and tetramethylpiperidines.

In addition, the photoreceptor of the present invention may also contain at least one electron accepting material for the purpose of elevating the sensitivity of the photoreceptor, reducing the residual potential thereof and reducing the fatigue thereof in repeated use. Examples of the electron accepting substances include succinic acid anhydride, maleic acid anhydride, dibromomaleic acid anhydride, phthalic acid anhydride, tetrabromophthalic acid anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among the above, fluorenone compounds, quinone compounds as well as benzene derivatives having an electron-attracting substituent such as Cl, CN and $NO_2$ are particularly preferred.

The present invention will be explained in more detail by referring to the following examples, but the present invention is not construed as being limited thereto. All the parts, percents and the like in the following examples and comparative examples are by weight unless otherwise indicated.

EXAMPLE 1

A solution comprising 10 parts of a zirconium compound ("Orgatic ZC540", trade name by Matsumoto Pharmaceutical Co.), one part of a silane compound ("A1110", trade name by Nippon Uncar Co.), 40 parts by i-propanol and 20 parts of butanol was coated on an aluminum base, as an electroconductive support, by dip-coating and dried by heating at 150° C. for 10 minutes to form a subbing layer having a thickness of 0.1 μm on the base.

One part of x-type metal-free phthalocyanine crystals were blended with one part of a polyvinyl butyral resin ("S-Lec BM-S", trade name by Sekisui Chemical Co.) and 100 parts of cyclohexanone and milled in a sand mill along with glass beads therein for one hour. Then, the coating composition thus obtained was coated over the subbing layer by dip-coating and dried by heating at 100° C. for 10 minutes to form a charge generating layer having a thickness of 0.15 μm thereon.

8 parts by weight of the Compound (I-27) as a charge transporting material and 12 parts by weight of the Compound (II-1) as a binder resin were dissolved in 85 parts by weight of monochlorobenzene, and to the resulting solution were added fine grains of a benzoguanamine-formaldehyde condensate ("Epostar MS", trade name by Nippon Shokubai K. K.) in an amount of 3 parts by weight based on the solid content of the solution. The mixture was milled in a sand mill along with glass beads therein for 3 hours to obtain a coating composition. The coating composition was coated over the charge generating layer by dip-coating and dried by heating at 120° C. for one hour to form a charge transporting layer having a thickness of 20 μm on the charge generating layer.

For determining the electrophotographic characteristics of the electrophotographic photoreceptor thus formed, the photoreceptor was electrically charged by corona-discharging of −6 KV under a normal-temperature and normal-humidity condition (20° C., 40% RH), using an electrostatic copying paper testing device ("Electrostatic Analyzer EPA-8100", manufactured by Kawaguchi Electric Co.), and a 800 nm monochromatic tungsten light as generated with a monochrometer was irradiated over the surface of the photoreceptor to an energy of 1 $\mu W/cm^2$. Under the condition, the surface potential $V_0$ (volt) and the half-value exposure $E_{\frac{1}{2}}$ ($erg/cm^2$) of the photoreceptor were measured. A white light of 10 luxes was next irradiated thereto for one second, whereupon the residual potential $V_R$ (volt) was measured. The results obtained are shown in Table 4 below.

EXAMPLE 2

An electrophotographic photoreceptor was prepared in the same manner as in Example 1, except that fine grains of a melamine-formaldehyde condensate ("Epostar S", trade name by Nippon Shokubai K. K.) were used in place of those of the benzoguanamine-formaldehyde condensate. The resulting photoreceptor was tested in the same manner as in Example 1. The results obtained are shown in Table 4 below.

EXAMPLE 3

An electrophotographic photoreceptor was prepared in the same manner as in Example 1, except that Compound (I-15) was used in place of Compound (I-27) and that Compound (II-11) was used in place of Compound (II-1). The resulting photoreceptor was tested in the same manner as in Example 1. The results obtained are shown in Table 4 below.

EXAMPLE 4

An electrophotographic photoreceptor was prepared in the same manner as in Example 2, except that Compound (I-15) was used in place of Compound (I-27) and that Compound (II-11) was used in place of Compound (II-1). The resulting photoreceptor was tested in the same manner as in Example 1. The results obtained are shown in Table 4 below.

COMPARATIVE EXAMPLE 1

An electrophotographic photoreceptor was prepared in the same manner as in Example 1, except that the fine grains of benzoguanamine-formaldehyde condensate were not added. The resulting photoreceptor was tested in the same manner as in Example 1. The results obtained are shown in Table 4 below.

COMPARATIVE EXAMPLES 2 TO 4

Electrophotographic photoreceptors were prepared in the same manner as in Example 1, except that $WO_2$ (product by Nippon Shokubai K. K.), $SiO_2$ (product by Nippon Shokubai) or a silicone resin (Tospearl 103, trade name by Toshiba Silicone Co.) was used in place of the fine grains of benzoguanamine-formaldehyde condensate. The resulting photoreceptors were tested in the same manner as in Example 1. The results obtained are shown in Table 4 below.

TABLE 4

| | Charge transporting Layer | | | | Electric characteristics | | |
|---|---|---|---|---|---|---|---|
| | Fine grains | | Charge transporting | | | | |
| | Kind | Average grain size | material | Dispersibility | $V_0$(V) | $E_{\frac{1}{2}}$($erg/cm^2$) | $V_{RF}$(V) |
| Example 1 | Epostar S | 0.3 μm | I-27/II-1 | good | −812 | 8.9 | −73 |
| Example 2 | Epostar MS | 2 μm | I-27/II-1 | good | −809 | 8.7 | −68 |
| Example 3 | Epostar S | 0.3 μm | I-27/II-11 | good | −804 | 8.8 | −71 |
| Example 4 | Epostar MS | 2 μm | I-27/II-11 | good | −806 | 9.1 | −74 |
| Comparative Example 1 | — | — | I-27/II-1 | — | −823 | 8.2 | −62 |
| Comparative Example 2 | $WO_2$ | 0.5 μm | I-27/II-1 | good | −503 | — | — |
| Comparative Example 3 | $SiO_2$ | 0.3 μm | I-27/II-1 | good | −832 | 15.2 | −164 |
| Comparative Example 4 | Tospearl 103 | 0.3 μm | I-27/II-1 | good | −798 | 8.8 | −93 |

EXAMPLES 5 TO 8 AND COMPARATIVE EXAMPLES 5 TO 8

Drum-type photoreceptors were prepared under the same conditions of Examples 1 to 4 and Comparative Examples 1 to 4. Each of them was set in a semiconductor laser printer ("FX XP-15", manufactured by Fuji Xerox Co.) and repeated duplication was effected 10,000 times. At the 10,000th duplication, the printed image was evaluated with respect to the image fault and the abraded amount of the surface of the photoreceptor was measured. The results obtained are shown in Table 5 below.

TABLE 5

| | Abraded amount (nm/1,000 cycles) | Image quality (after 10,000 prints) |
|---|---|---|
| Example 5 | 12.4 | Good with no defect |
| Example 6 | 11.1 | Good with no defect |
| Example 7 | 10.2 | Good with no defect |
| Example 8 | 9.7 | Good with no defect |
| Comparative Example 5 | 28.3 | Some scratched |
| Comparative Example 6 | 37.5 | No image formed |
| Comparative Example 7 | 11.0 | Many black peppers |
| Comparative Example 8 | 33.8 | Good with no defect |

EXAMPLE 9

An electroconductive support was prepared by liquid horning treatment of an aluminium pipe having a diameter of 40 mm so as to roughen the surface thereof to have Ra of 0.1 μm. A coating composition comprising 10 parts by weight of a polyamide resin ("Laquamide L5003", product by Dai Nippon Ink and Chemicals Co.), 150 parts by weight of methyl alcohol and 40 parts by weight of water was coated over the support and dried to form a subbing layer having a thickness of 1 μm thereon.

A mixture composed of 15 parts by weight of x-type metal-free phthalocyanine as a charge generating material, 10 parts by weight of a polyvinyl butyral resin ("S-Lec BM-S", product by Sekisui Chemical Co.) and 300 parts by weight of n-butyl alcohol was milled in a sand mill for 5 hours. The resulting dispersion was coated over the subbing layer and dried to form thereon a charge generating layer having a thickness of 0.2 μm.

4 parts by weight of N,N'-diphenyl-N,N'-bis(3-methylphenyl)-[1,1'-biphenyl]-4,4'-diamine and 6 parts by weight of bisphenol Z polycarbonate resin (molecular weight, 40,000) were dissolved in 80 parts by weight of chlorobenzene. To the resulting solution were added 0.5 part by weight of fine grains of benzoguanamine-melamine-formaldehyde condensate ("Epostar M30", product by Nippon Shokubai K. K.; benzoguanamine/-melamine: 6.5/3.5) and milled in a sand mill for 6 hours. The resulting coating composition was coated over the charge generating layer and dried to form thereon a charge transporting layer having a thickness of 22 μm. Thus, an electrophotographic photoreceptor with three-layer laminate structure was formed.

COMPARATIVE EXAMPLE 9

A photoreceptor was prepared in the same manner as in Example 9, except that the fine grains of benzoguanamine-melamine-formaldehyde condensate were replaced by fine grains of melamine-formaldehyde condensate ("Epostar S" product by Nippon Shokubai K. K.).

COMPARATIVE EXAMPLE 10

A photoreceptor was prepared in the same manner as in Example 9, except that the fine grains of benzoguanamine-melamine-formaldehyde condensate were replaced by fine grains of benzoguanamine-formaldehyde condensate ("Epostar L-15", product by Nippon Shokubai K. K.).

COMPARATIVE EXAMPLE 11

A photoreceptor was prepared in the same manner as in Example 9, except that no fine grains were added.

COMPARATIVE EXAMPLES 12 TO 14

Photoreceptors were prepared in the same manner as in Example 9, except that the fine grains as indicated in Table 6 below were used in place of the grains of benzoguanamine-melamine-formaldehyde condensate.

Each of the electrophotographic photoreceptors as prepared in Example 9 and Comparative Examples 9 to 14 was set in a laser beam printer ("XP-11"; manufactured by Fuji Xerox Co.), and the surface potential at the position of the developer under no exposure was set to be 800 V by controlling the grid voltage of the scorotron electric charger. By controlling the voltage to be applied to the laser, the quantity of light ($E_{\frac{1}{2}}$) to yield the surface potential of the photoreceptor under complete uniform exposure thereof of being 400 V and the residual potential to have the maximum quantity of light (about 30 mJ/m$^2$) under the same condition were obtained. The values thus obtained indicate the sensitivity of the photoreceptor. Printing was conducted under the optimum exposure condition to each photoreceptor, and the image quality of the resulting prints was evaluated by reversal development.

In addition, each photoreceptor was subjected to a running test under the optimum exposure condition. Further, the abraded amount of the surface of each photoreceptor was measured to the number of rotation of the drum in repeated use.

The results are shown in Table 6 below.

EXAMPLE 10

On an aluminium pipe having a diameter of 40 mm, the surface of which had been roughened by horning to have Ra=0.09 μm, was coated a coating composition composed of 10 parts by weight of a mixture of an organic zirconium compound and an organic silane compound (the ratio "ZC540"/"A1110": 2/1 by mol), 150 parts by weight of n-butyl alcohol and 40 parts by weight of ethyl alcohol and dried to form thereon a subbing layer having a thickness of 0.2 μm.

A mixture composed of 15 parts by weight of α-type titanyl phthalocyanine pigment as a charge generating material, 10 parts by weight of a vinyl chloride-vinyl acetate-maleic acid copolymer resin ("VMCC", product by Union Carbide Co.; vinyl chloride (83% by weight)—vinyl acetate (16% by weight)—maleic acid (1% by weight)) and 300 parts by weight of n-butyl acetate was milled in a paint shaker for 2 hours. The resulting coating composition was coated over the subbing layer and dried to form thereon a charge generating layer having a thickness of 0.15 μm.

4 parts by weight of N,N'-diphenyl-N,N'-bis(3-methylphenyl)-[1,1'-biphenyl]-4,4'-diamine and 6 parts by weight of bisphenol Z polycarbonate resin (molecular weight: 40,000) were dissolved in 80 parts by weight of chlorobenzene. The resulting solution was coated over the charge generating layer and dried to form thereon a charge transporting layer having a thickness of 21 μm.

A dispersion comprising 60 parts by weight of a polyurethane resin ("Retan 4000", product by Kansai Paint Co.), 10 parts by weight of a hardening agent ("Coronate HL", product by Nippon Polyurethane Co.), 40 parts by weight of tin oxide powder, 0.5 part by weight of fine grains of a benzoguanamine-melamine-formaldehyde condensate ("Epostar M30", product by Nippon Shokubai K. K.), 80 parts by weight of methylene chloride and 70 parts by weight of 1,1,2-trichloroethane was coated over the charge transporting layer by spray-coating and hardened at 150° C. for one hour to form thereon a surface protecting layer having a thickness of about 1.5 μm.

The performance of the photoreceptor thus prepared was evaluated in the same manner mentioned above. The results obtained are shown in Table 6.

COMPARATIVE EXAMPLE 15

A photoreceptor was prepared in the same manner as in Example 10, except that the fine grains of benzoguanamine-melamine-formaldehyde condensate were not added to the surface protecting layer. The performance of the resulting photoreceptor was evaluated also in the same manner as above. The results are shown in Table 6.

TABLE 6

| | Fine grains added | Average grain size (μm) | $E_{\frac{1}{2}}$ (mJ/m$^2$) | Residual potential (Volt) | Abraded amount (nm/K cycle) | Image quality |
|---|---|---|---|---|---|---|
| Example 9 | Benzoguanamine-melamine-formaldehyde condensate (Eposter M30) | 3 | 7.6 | 145 | 12.0 | Good, no fault |
| Comparative Example 9 | Melamine-formaldehyde condensate (Eposter S) | 0.3 | 12.5 | 445 | 10.7 | Low density, partly white peppers |
| Comparative Example 10 | Benzoguanamine-formaldehyde condensate (Eposter L-15) | 15 | 7.8 | 190 | 27.1 | Partly white peppers |
| Comparative Example 11 | No | — | 7.5 | 130 | 32.0 | Good, no fault |
| Comparative Example 12 | $WO_3$ (product by Nippon Shokubai KK) | 0.5 | charged low | — | 45.3 | No image obtained |
| Comparative Example 13 | $SiO_2$ (Seahoster KE-P30, product by Nippon Shokubai KK) | 0.3 | 13.9 | 380 | 10.9 | Low density, partly white peppers |
| Comparative Example 14 | Si resin (Tospearl 103, product by Toray Silicone Co.) | 0.3 | 7.6 | 210 | 32.4 | Good, no fault |
| Example 10 | Benzoguanamine-melamine-formaldehyde condensate (Eposter M30) | 3 | 4.4 | 75 | 12.0 | Good, no fault |
| Comparative Example 15 | No | — | 4.3 | 70 | 21.7 | Good, no fault |

In the electrophotographic photoreceptor according to the first aspect of the present invention, since at least the outermost layer of the light-sensitive layer thereof contains the specific binder resin and fine grains, the photoreceptor has a high light sensitivity and excellent stability to repeated use and also has high wearing resistance and releasability, as is obvious from the results in the above examples and comparative examples.

Since the electrophotographic photoreceptor according to the second aspect of the present invention contains, in at least the outermost layer thereof, fine grains of a benzoguanamine-melamine-formaldehyde condensate, the photoreceptor has a high mechanical strength with little abrasion of the surface layer.

The photoreceptor of the present invention therefore has an excellent capacity of constantly forming good images with little deterioration of the electric characteristics of itself even under environmental fluctuation.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising an electroconductive support having thereon a light-sensitive layer, at least the outermost layer of said light-sensitive layer containing fine grains of a benzoguanamine-melamine-formaldehyde condensate having an average grain size of from 0.03 to 4 μm.

2. An electrophotographic photoreceptor as claimed in claim 1, wherein said light-sensitive layer comprises a charge generating layer and a charge transporting layer, which are laminated in this order on said electroconductive support, and said outermost layer is said charge transporting layer.

3. The electrophotographic photoreceptor as claimed in claim 1, wherein said fine grains have an electric resistance of $10^9$ ohm cm. or less.

4. The electrophotographic photoreceptor as claimed in claim 1, wherein said fine grains of a benzoguanamine-melamine-formaldehyde condensate has a proportion of benzoguanamine to melamine of from 1/9 to 9/1 by weight.

5. The electrophotographic photoreceptor as claimed in claim 4, wherein said fine grains of a benzoguanamine-melamine-formaldehyde condensate has a proportion of benzoguanamine to melamine of from 3/7 to 7/3 by weight.

6. An electrophotographic photoreceptor as claimed in claim 1, wherein said fine grains of a benzoguanamine-melamine-formaldehyde condensate are contained in an amount of from 0.01 to 20% by weight based on the solid content of said outermost layer.

7. An electrophotographic photoreceptor as claimed in claim 6, wherein said fine grains of a benzoguanamine-melamine-formaldehyde condensate are contained in an amount of from 0.1 to 10% by weight based on the solid content of said outermost layer.

* * * * *